US006557790B2

(12) United States Patent
Splinter

(10) Patent No.: US 6,557,790 B2
(45) Date of Patent: May 6, 2003

(54) CIRCUIT GRINDING APPARATUS WITH HIGH-PRESSURE ROLLER MILL AND SIFTER

(75) Inventor: Christian Splinter, Pulheim (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 10/027,403

(22) Filed: Dec. 20, 2001

(65) Prior Publication Data

US 2002/0079391 A1 Jun. 27, 2002

(30) Foreign Application Priority Data

Dec. 21, 2000 (DE) ..... 100 63 798

(51) Int. Cl.[7] ..... B02C 23/12

(52) U.S. Cl. ..... 241/74; 241/79.3; 241/80; 241/222

(58) Field of Search ..... 241/74, 79.3, 222, 241/80

(56) References Cited

U.S. PATENT DOCUMENTS 5,772,133 A * 6/1998 Hall ..... 241/74

6,032,887 A * 3/2000 Strasser et al. ..... 241/79

FOREIGN PATENT DOCUMENTS

JP 6-246177 * 9/1994 ..... 241/74

* cited by examiner

*Primary Examiner*—Mark Rosenbaum
(74) *Attorney, Agent, or Firm*—Sonnenschein Nath & Rosenthal

(57) ABSTRACT

In order to further develop a circuit grinding apparatus with a roller mill or roller press for material bed disintegration of granular material and with at least one integrated sifter, where the mill and the sifter are disposed within two stationary side walls between which a material conveyor ring is rotatably seated and can be set into rotation for an internal circulation of material in such a way that the rotatably seated material conveyor ring, which has a very large diameter and rotates in operation, is as light as possible and the rotary actuator is configured as simply as possible, it is proposed in accordance with the invention to dispose around the bottom circumferential area of the material conveyor ring more than two, for example four rolls supporting the ring on the bottom, where two adjacent bearing rolls in circumferential direction of the ring are positioned at the ends of at least one common rocker lever which, in turn, is supported on the machine frame via a tilting joint.

20 Claims, 1 Drawing Sheet

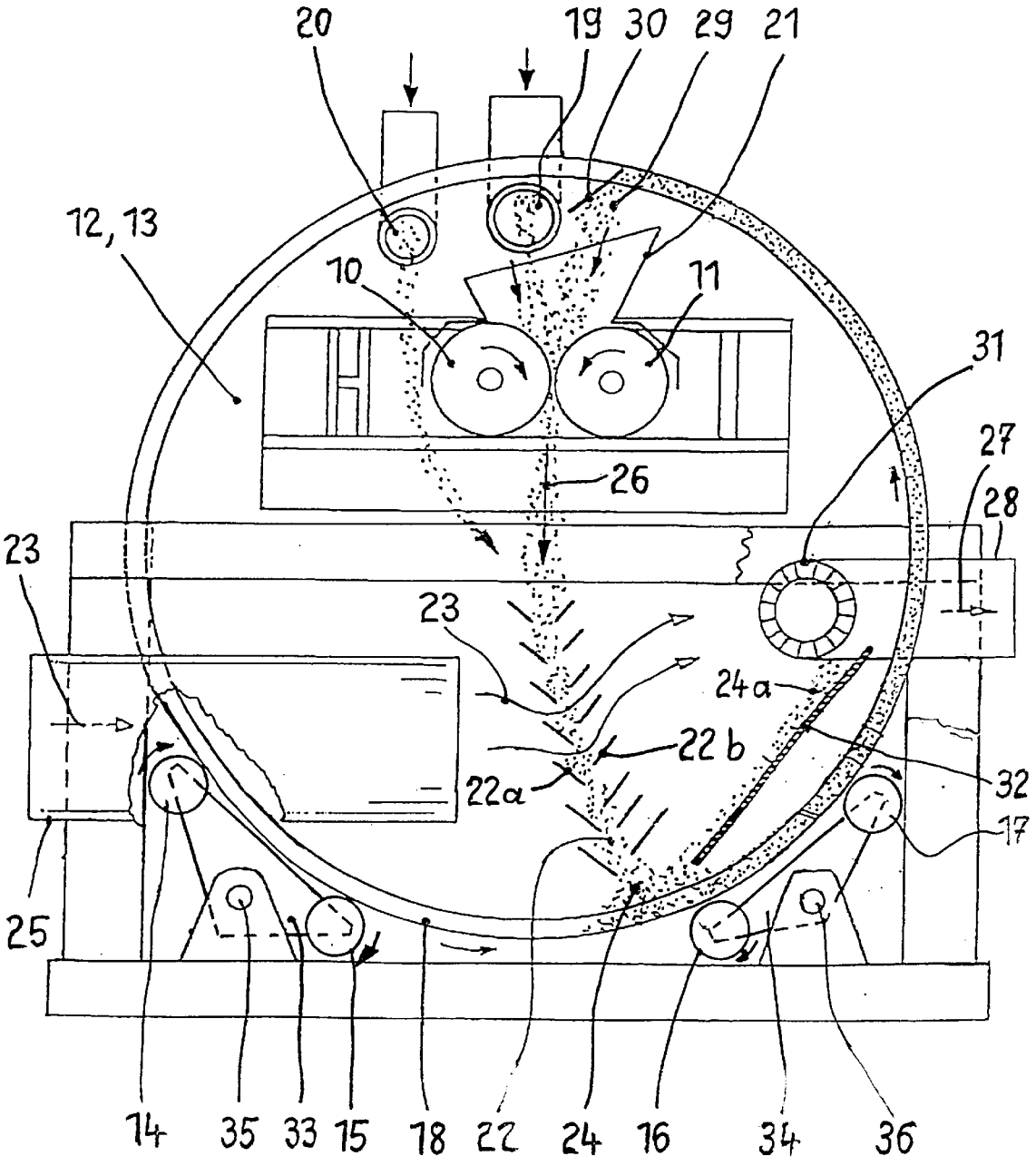
20
19
30
29
21
12, 13
10
11
31
27
28
26
23
23
24a
22b
22a
32
17
25
14
35
33
15
18
22
24
16
34
36

CIRCUIT GRINDING APPARATUS WITH HIGH-PRESSURE ROLLER MILL AND SIFTER

BACKGROUND OF THE INVENTION

The invention relates to a circuit grinding apparatus with a high-pressure roller mill for pressure disintegrating granular material and with at least one integrated sifter where both units are disposed within two stationary side walls between which a material conveyor ring is rotatably seated on rolls and capable of being set into rotation for an internal circulation of material and where the inflow of material takes place through one or more openings in one or in both housing side walls from the side and the material likewise exits laterally through one or more openings in the housing side wall.

A milling device of the above type (DE-A 197 26 523, U.S. Pat. No. 6,032,887), whose disclosure is incorporated herein by reference is a highly compact circuit grinding apparatus with a high-pressure roller mill or roller press for pressure disintegrating or material bed disintegrating granular material and with an integrated sifter. The roller mill or roller press with its two rollers is encompassed by a housing comprising two stationary, i.e., non-rotating side walls between which a rotatably seated material conveyor ring, which can be set into rotation by means of a rotary actuator, is disposed for an internal circulation of material. In the known grinding apparatus, in the working area within the rotating material conveyor ring below the nip of the roller press, a static and/or dynamic sifter is integrated through which the sifter air flows, and the coarse grain portion or oversized material discharged by the sifter or sifters falls downward onto the cylindrical inside surface of the rotating material conveyor ring. This conveyor ring carries the press discharge material (scab material) or oversized material de-agglomerated in the sifting upward into the area of the upper vertex point of the ring from where said material falls from the top into the feeder shaft of the roller press, thus creating the internal circulation of material. At the same time, the sifter air flow loaded with the fine grain portion of the grinding material is drawn out of the working area and is separated from the fine grain portion outside of the circuit grinding apparatus. In such a compact circuit grinding apparatus the sifter integrated in the rotating material conveyor ring can be disposed above instead of below the roller press (DE-A-196 30 687, U.S. Pat. No. 5,918,823), the disclosure of which is incorporated herein by reference.

Therefore, in the circuit grinding apparatus of this type, bucket conveyors or other space-consuming conveyors for transporting the mill or press discharge material and the oversized sifter material to the mill or press inlet are omitted. With the rotating material conveyor ring, a multiple internal circuit of material with multiple material bed stressing of the material is thus achieved in the smallest space and with a low outlay of machinery where even high material circuit loads caused by reduced roller press pressures, for example, have to be managed.

In the known circuit grinding apparatus the material conveyor ring encompassing the roller mill and the sifter, which ring can have a large diameter of more than 10 m in industrial applications, is rotatably seated on two rolls disposed spaced apart from each other and supporting the weight of the material conveyor ring on the bottom, one of which rolls is actuated. In order to reduce the risk of deformation of the material conveyor ring having a large diameter, said ring has to be constructed relatively rigidly which results in a heavy weight. Seating the rotating material conveyor ring on more than two roll bearing stations, however, is not easily feasible because the additional bearing stations would create a statically undefined system in which the bearing rolls are not all evenly loaded.

SUMMARY OF THE INVENTION

The aim of the invention is to further develop a circuit grinding apparatus of the above described type such that the material conveyor ring, which is rotatably seated, has a very large diameter and rotates in operation, is as light in weight as possible and the rotary actuator is constructed as simply as possible.

The circuit grinding apparatus of the invention is characterized in that distributed over the bottom circumferential area of the material conveyor ring (as seen in circumferential direction) more than two, for example three or four or even more rolls are disposed supporting the material conveyor ring on the bottom, where two adjacent bearing rolls in circumferential direction of the ring are positioned at the ends of a common rocker lever, which, in turn, is supported on the machine frame via a tilting joint. Especially advantageously, one rocker lever is provided on either side of the vertical plane applied through the axis of rotation of the material conveyor ring on whose ends the bearing rolls are positioned parallel to the axis, i.e., a total of four bearing rolls or four wheel sets are provided that securely support the rotating material conveyor ring on the bottom. Because of the higher number of bearing rolls or wheel sets, the overall range of support for the material conveyor ring can be increased and the load per roll or wheel set and the pressing between the surfaces of the material conveyor ring and the rolls and the risk of deformation are reduced. The material conveyor ring can be constructed so as to be light in weight. The support rolls or bearing rolls and the actuated roll can have a small diameter, which simplifies the motor actuation of the driving roll, allowing a direct actuation of the driving wheel sets and resulting in the omission of high-maintenance elements, such as toothed gearing, propeller shafts and/or V-belt drives. If a gearing is used for the rotary actuator, its transmission ratio can be lower.

The articulated rocker lever design achieves a statically defined system for the seating of the material conveyor ring where all rolls or wheel sets are evenly loaded. This even load is maintained even when the position or the slope of the axis of rotation of the material conveyor ring changes, at least when the tilting joint of the rocker levers is a universal ball joint or a socket joint. One of the tilting joints may be a cylindrical joint with a fixed axis of rotation parallel to the axis of rotation of the conveyor ring so as to better fasten the material conveyor ring. Seating the material conveyor ring in accordance with the invention improves its concentricity. Also, the flexibility of the rocker levers and thus the bearing rolls or wheel sets reduces the negative effects caused by any circularity errors in the material conveyor ring and by any gaps between the joints of the segments of which the rotating material conveyor ring is composed.

The invention and its other characteristic features and advantages will be demonstrated in more detail by means of the schematic exemplary embodiment shown in the drawing.

BRIEF DESCRIPTION OF THE DRAWING

The drawing shows a vertical profile of the compact circuit grinding apparatus of the invention crosswise to the axis of rotation of the rotatably seated material conveyor ring with integrated high-pressure roller press and sifter looking into the working area.

DETAILED DESCRIPTION OF THE PREFERRED EMBODIMENTS

In the circuit grinding apparatus of the invention with the high-pressure roller mill or roller press integrated in the working area for material bed disintegrating granular material with the two rollers 10, 11 actuated in counter-rotation and separated by a nip and with the integrated at least one sifter the mill and the sifter system are encompassed or surrounded by a housing comprising of two stationary, i.e., non-rotating housing side walls 12, 13 (in the drawing the front side wall 12 is transparent, rear side wall 13), between which a rotatably seated material conveyor ring 18 is disposed on four rolls or wheel sets 14, 15, 16, 17 for an internal circulation of material. The rotary actuation of the material conveyor ring 18 takes place via its cylindrical casing, for example by means of the actuated roll or the actuated wheel set 15. The bearing pedestals for the two rollers 10, 11 and the four rolls 14 to 17 are positioned outside the two housing end walls 12, 13 in the machine frame.

The material conveyor ring 18 can have a diameter of approx. 12 m, for example, a width of between 0.5 and approx. 2 m, for example, and a peripheral velocity of between 20 and 30 m/sec., for example.

The grinding material enters through openings 19 and 20 in one or in both housing side walls 12, 13 into the working area of the circuit grinding apparatus, specifically through opening 19 directly into the material feeder shaft 21 of the roller mills and/or through opening 20 directly to the sifter in the space below the roller mill. In the exemplary embodiment, a static cascade sifter is disposed in the space below the nip of the roller mill or roller press 10, 11 with two sifter zone limiting walls forming a sifting zone 22 between them and through which sifting air 23 or, if applicable, hot gas as a drying gas flows approximately in a cross-current, which walls are provided with cascade-like or louver-like guide plates 22*a*, 22*b* inclined downward at an angle for discharging the sifted out coarse grain portion or oversized material 24, where said two guide plate walls and thus the sifter zone 22 in between are disposed so as to be inclined at an angle which varies from the vertical line.

The sifter air 23 enters from the side through at least one feeder housing 25 through at least one of the side walls 12, 13 into the working area below the roller press. The static cascade sifter through which the sifter air flows acts as a de-agglomerator for the scab material 26 from the roller press, which, if applicable, is fed together with the fresh grinding material from opening 20 to the cascade sifter. In any case, the sifter air 23 sifts the fine grain portion out of the sifting material, and the sifter air loaded with the fine material 27 is drawn out of the circuit grinding apparatus via line 28 leading out through one or both side walls 12, 13, while the coarse grain portion or oversized material 24 separated by the cascade sifter from the sifting material reaches the inside track of the rotating material conveyor ring 18 which rotates at supercritical speed and carries the oversized portion 24 via the effects of friction and centrifugal force upward into the area of the upper vertex point of the rotating ring where said material 29 is removed by means of a stripping device 30 and discharged into the feeder shaft 21 of the roller press 10, 11. However, it would also be feasible to let the material conveyor ring 18 rotate at between approx. 40 and 80% of the critical speed, for example, where in this case, the material conveyor ring 18 would carry the material up to in front of the upper vertex point of the ring by means of lifting elements from where it falls downward as a result of gravity.

In the exemplary embodiment of the compact circuit grinding apparatus of the invention shown in the drawing, a dynamic sifter with a rotatably seated rod-type basket 31 is arranged downstream of the static cascade sifter. In this case, the side walls 12, 13 of the working area of the circuit grinding apparatus of the invention are also the sifting housing both in the static cascade sifter and in the dynamic rod-type basket sifter. In the area of the ends of the rod-type basket 31 the discharge manifold or manifolds 28 are disposed in the adjacent side walls 12, 13 for drawing out the sifter air loaded with the fine material 27. The further coarse grain or oversized portion 24*a* separated at the periphery of the rod-type basket 31 is also guided to the inside track of the rotating material conveyor ring 18 via a chute 32 from where it is recirculated to the material bed roller mill for the purpose of reusing the material bed for said material which has already been relieved of the fine material 27.

The circuit grinding apparatus of the invention is characterized in that on both sides of the vertical plane applied through the axis of rotation of the material conveyor ring one rocker lever 33 and 34 is disposed on whose ends the bearing rolls or wheel sets 14, 15 and 16, 17 are seated parallel to the axis. Each of said rocker levers 33 or 34 is supported via a tilting joint 35 or 36 on the machine frame. The tilting joint 35 or 36 of the rocker levers can comprise a cylindrical joint positioned axis-parallel to the axis of rotation of the material conveyor ring 18, or especially advantageously, one of the two tilting joints can comprise a universal ball joint or a socket joint.

It is understood that the invention is realized even if, in departure from the exemplary embodiment of the drawing, only one rocker lever is provided, i.e. if one of the two rocker levers is replaced by a stationary wheel set, which results in a stable three-point bearing. Another option is to provide more than four wheel sets and another option is to couple additional rocker levers to the ends of the rocker levers 33 and 34. Such a configuration would result in seating the material conveyor ring 18 on eight wheel sets.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A circuit grinding apparatus with high-pressure roller mill for pressure disintegrating granular material and with at least one integrated sifter where both units are disposed within two stationary side walls between which a material conveyor ring is rotatably seated on rolls and can be set into rotation for an internal circulation of material, and where the material enters through one or more openings in one or in both housing side walls from the side and the material likewise exits laterally through one or more openings in the housing side wall, wherein distributed over the circumferential area of the material conveyor ring more than two rolls are disposed supporting the material conveyor ring on the bottom and two adjacent bearing rolls in circumferential direction of the ring are seated at the ends of at least one common rocker lever, which, in turn, is supported on a machine frame via a tilting joint.

2. A circuit grinding apparatus according to claim 1, wherein, on both sides of a vertical plane applied through an axis of rotation of the material conveyor ring, at least one of said rocker levers is disposed, on whose ends said bearing rolls are positioned to rotate about axes parallel to said ring axis.

3. A circuit grinding apparatus according to claim 1, wherein the tilting joint of the at least one rocker lever comprises a cylinder joint positioned axis-parallel to an axis of rotation of the material conveyor ring.

4. A circuit grinding apparatus according to claim 1, wherein the tilting joint of the at least one rocker lever is a universal ball joint.

5. A circuit grinding apparatus according to claim 1, wherein the tilting joint of the at least one rocker lever is a socket joint.

6. A circuit grinding apparatus according to claim 1, wherein on an axis disposed on each end of the rocker levers, two rolls are positioned as a wheel set at a distance from each other.

7. A circuit grinding apparatus with high-pressure roller mill for pressure disintegrating granular material and with at least one integrated sifter, comprising a housing enclosing said roller mill and said sifter and having two stationary lateral end walls and a conveyor ring rotatably seated in and extending therebetween;

at least one product material admission in at least one of said end walls for admitting said granular product material into said housing, at least one product material discharge in at least one of said end walls for discharging disintegrated granular material from said housing, at least three rolls disposed to support said conveyor ring from beneath, wherein at least an adjacent two of the rolls, in a circumferential direction of said ring, are seated on a common rocker lever supported below said ring via a tilting joint.

8. A circuit grinding apparatus according to claim 7, wherein, on both sides of a vertical plane applied through an axis of rotation of the conveyor ring, at least one of said rocker levers is disposed, on whose ends said bearing rolls are positioned to rotate about axes parallel to said ring axis.

9. A circuit grinding apparatus according to claim 7, wherein said tilting joint of said at least one rocker lever comprises a cylinder joint positioned axis-parallel to an axis of rotation of said conveyor ring.

10. A circuit grinding apparatus according to claim 7, wherein said tilting joint of joint of said at least one rocker lever is a universal ball joint.

11. A circuit grinding apparatus according to claim 7, wherein said tilting joint of said at least one rocker lever is a socket joint.

12. A circuit grinding apparatus according to claim 7, wherein on an axis disposed on each end of said rocker levers, two rolls are positioned as a wheel set at a distance from each other.

13. A circuit grinding apparatus with high-pressure roller mill for pressure disintegrating granular material and with at least one integrated sifter, comprising a housing enclosing said roller mill and said sifter comprising a conveyor ring arranged to be rotatable about said roller mill and said sifter;

at least three rolls supportingly engaging said conveyor ring from beneath, wherein at least an adjacent two of the rolls, in a circumferential direction of said ring, are carried on a common rocker lever supported below said ring via a tilting joint.

14. A circuit grinding apparatus according to claim 13, wherein, at least one of said rocker levers is disposed on each side of a vertical plane extending through an axis of rotation of the conveyor ring, a bearing roll being positioned on each end of each rocker lever positioned to rotate about axes parallel to said ring axis.

15. A circuit grinding apparatus according to claim 13, wherein said tilting joint of said at least one rocker lever comprises a cylinder joint positioned with an axis of rotation parallel to an axis of rotation of said conveyor ring.

16. A circuit grinding apparatus according to claim 13, wherein said tilting joint of said at least one rocker lever comprises a universal ball joint.

17. A circuit grinding apparatus according to claim 13, wherein said tilting joint of said at least one rocker lever comprises a socket joint.

18. A circuit grinding apparatus according to claim 13, wherein on an axis disposed on each end of said rocker lever, two rolls are positioned as a wheel set at a distance from each other.

19. A circuit grinding apparatus according to claim 13, wherein two rocker levers are provided, with at least two rolls carried on each rocker lever.

20. A circuit grinding apparatus according to claim 13, wherein said circuit grinding apparatus includes a machine frame and said rocker lever is supported on said machine frame via said tilting joint.

* * * * *